US007175337B2

(12) United States Patent
Bergman

(10) Patent No.: US 7,175,337 B2
(45) Date of Patent: Feb. 13, 2007

(54) METHOD AND APPARATUS FOR MIXING PULVEROUS MATERIAL WITH LIQUID

(75) Inventor: John Bergman, Ulm (DE)

(73) Assignee: Metso Paper, Inc., Helsinki (FI)

( * ) Notice: Subject to any disclaimer, the term of this patent is extended or adjusted under 35 U.S.C. 154(b) by 305 days.

(21) Appl. No.: 10/495,809

(22) PCT Filed: Nov. 21, 2002

(86) PCT No.: PCT/FI02/00937

§ 371 (c)(1),
(2), (4) Date: May 17, 2004

(87) PCT Pub. No.: WO03/043723

PCT Pub. Date: May 30, 2003

(65) Prior Publication Data

US 2005/0002270 A1 Jan. 6, 2005

(30) Foreign Application Priority Data

Nov. 23, 2001 (FI) ..... 20012293

(51) Int. Cl.
*B01F 15/02* (2006.01)

(52) U.S. Cl. ..... 366/165.2; 366/178.1

(58) Field of Classification Search ..... 366/165.1, 366/165.2, 165.5, 167.1, 173.1, 174.1, 175.2, 366/178.1, 178.2, 178.3; 406/47–48
See application file for complete search history.

(56) References Cited

U.S. PATENT DOCUMENTS 2,886,297 A * 5/1959 Ralph ..... 366/76.91
3,298,669 A * 1/1967 Zingg ..... 366/107
3,542,342 A * 11/1970 Barron ..... 366/178.1
3,794,299 A 2/1974 Wagner et al.
3,994,480 A 11/1976 Fothergill et al.

(Continued)

FOREIGN PATENT DOCUMENTS

EP 0 050 312 A2 4/1982

(Continued)

OTHER PUBLICATIONS

International Search Report issued in PCT/FI02/00937.

(Continued)

*Primary Examiner*—Charles E. Cooley
(74) *Attorney, Agent, or Firm*—Stiennon & Stiennon

(57) ABSTRACT

Liquid is supplied within a substantially vertical mixing chamber in a substantially tangential manner from a chamber top section, such that the liquid is deflected for rotatory motion against a chamber wall while advancing, in response to a pressure difference, downwards in the direction of a chamber longitudinal axis. Pulverous material is supplied by compressed air into the chamber (3) from the top section and into an air core (A) established by the liquid in rotatory motion, such that the pulverous material containing little air, and by being heavier than the air contained in the pulverous material and/or used for carrying the same, is driven in response to a centrifugal force into the liquid in rotatory motion, and the air separates towards the eddy center, and that the liquid containing pulverous material and the air supplied into the chamber, are discharged through an open bottom section of the chamber (3).

11 Claims, 2 Drawing Sheets

U.S. PATENT DOCUMENTS

| | | | | |
|---|---|---|---|---|
| 4,108,732 | A * | 8/1978 | Nuttall, Jr. | 366/165.1 |
| 4,345,841 | A | 8/1982 | Day | |
| 4,662,759 | A * | 5/1987 | Leibee et al. | 366/178.3 |
| 4,688,945 | A | 8/1987 | Brazelton et al. | |
| 5,122,348 | A | 6/1992 | St. Elmo Spence et al. | |
| 5,344,619 | A * | 9/1994 | Larwick et al. | 422/261 |
| 5,383,725 | A * | 1/1995 | Swisher et al. | 366/22 |
| 5,857,773 | A | 1/1999 | Tammelin | |
| 6,045,255 | A * | 4/2000 | Ogier | 366/165.2 |
| 6,796,704 | B1 * | 9/2004 | Lott | 366/165.2 |
| 2005/0002270 | A1 * | 1/2005 | Bergman | 366/165.2 |
| 2006/0164914 | A1 * | 7/2006 | Goto et al. | 366/165.2 |

FOREIGN PATENT DOCUMENTS

| | | | |
|---|---|---|---|
| EP | 0 460 804 | A1 | 12/1991 |
| EP | 1025896 | A1 * | 8/2000 |
| FI | 98792 | B | 5/1997 |
| GB | 979675 | A | 1/1965 |
| GB | 2 031 748 | A | 4/1980 |
| WO | WO 01/70382 | A1 | 9/2001 |
| WO | WO 03/043723 | A1 | 5/2003 |

OTHER PUBLICATIONS

International Preliminary Examination Report issued in PCT/FI02/00937.

* cited by examiner

METHOD AND APPARATUS FOR MIXING PULVEROUS MATERIAL WITH LIQUID

CROSS REFERENCES TO RELATED APPLICATIONS

This application is a U.S. national stage application of International application No. PCT/FI02/00937, filed Nov. 21, 2002, and claims priority on Finnish Application No. 20012293, Filed Nov. 23, 2001.

STATEMENT AS TO RIGHTS TO INVENTIONS MADE UNDER FEDERALLY SPONSORED RESEARCH AND DEVELOPMENT

Not Applicable.

BACKGROUND OF THE INVENTION

The invention relates to a method and an apparatus for mixing pulverous material with liquid.

Pulverous materials are mixed with liquids in a variety of processes. For example, a coating material used for coating paper or some other web-like material is prepared by mixing coating material components with each other for a desired coating material. Typically, some of the components are in liquid form, such as water or pigment slurry, and some of the components are in pulverous form that are subsequently admixed with liquid components.

Pulverous components are typically admixed or blended in with liquid components in a batch process by bringing a pulverous component and liquid together in a special mixer and by agitating the components with each other until the pulverous component has dispersed and/or dissolved in the liquid. In the preparation process for coating materials, in particular, a problem is that certain pulverous coating material components have a poor miscibility with liquid components. Particularly problematic mixing processes include e.g. dispersion of dry CMC (carboxymethyl cellulose) in pigment slurry and dispersion of retention polymers in water. Another problem in blending based on the conventional use of mixers is that it is highly complicated, and in many cases even impossible, to integrate it with a continuous preparation process.

Attempts have been made to alleviate the problem by longer mixing times. However, longer mixing times decrease the capacity of an entire preparation process and, respectively, increase the size and costs of mixing equipment. For example, the dispersion of CMC in pigment slurry in available mixing technology typically calls for mixing times of at least 45–90 minutes. This results in a significant fall in capacity as compared to having CMC pre-dissolved in water. However, if CMC is dissolved in water, the dry content of a final coating material falls to an essentially undesirable level. This, in turn, rules out the use of pre-dissolved CMC.

As for retention polymers, attempts have been made to mitigate the problem by means of pre-elutriation of polymers. For example, U.S. Pat. No. 5,857,773 discloses a dissolution method and apparatus for polymers. In the cited method, polymer is fed from a supply tank to a premixing tank by way of a dissolution head, wherein the polymer is supplemented relative to its flow direction first with air and then with water, said components being mixed in a mixing chamber included in the dissolution head upstream of the premixing tank. A problem with the cited method and apparatus, when applied in a coating material preparation process, is however that, during a coating process, the air and air bubbles, present in the coating material, develop roughness of paper surface, and even spots completely void of coating material. The problem is pronounced with certain types of coating materials, which take up more air than other coating materials. Such materials include e.g. coating compositions which contain talc. Therefore, a troublefree application of the cited method and apparatus would in several cases require the use of separate air vents for evacuating the coating material of air admixed with the coating material during the pre-dissolving process. One such air vent for expelling the air contained in a coating material is described in Patent publication FI98792.

U.S. Pat. No. 4,688,945 discloses a mixing apparatus, comprising a mixing chamber for mixing dry polymer with water. The apparatus comprises a tapered, downward convergent mixing chamber. Alongside the mixing chamber is a water supply channel, spiralling around the mixing chamber and having a downward converging profile for increasing the feed rate of water. According to the cited publication, polymer is supplied by a screw conveyor and blended in water fed into the mixing chamber for admixing the polymer with water. The mixture of water and polymer is guided from the mixing chamber into an upright mixing pipe, which is rotatable and functions as a mixer shaft for the actual mixing chamber. The mixture is carried along the mixing pipe to mixer paddles, whereby the mixture is delivered into a mixing tank. A problem with the cited apparatus is that the tapered or conical configuration of a mixing chamber may induce in the water or in the mixture of water and polymer supplied into the chamber, a tendency to strive upwards, thus disturbing the function of the apparatus. In addition, the cited publication does not disclose any feed rate for water, which must be sufficiently high for the water to effectively aspirate the polymer powder along for preventing its adherence to the walls of a supply chamber. Furthermore, the water supply channel disclosed in the cited publication is not practical for use with any liquid other than water, since for example pigment slurry, when delivered by way of a supply channel as described in the cited publication, could, as a result of its composition, obstruct, seriously deteriorate or even break the channel.

Patent publications U.S. Pat. No. 5,122,348, U.S. Pat. No. 3,994,480, GB 2,031,748 A and EP 0460804 A1 also disclose methods and equipment for mixing pulverous material with liquid in a conical mixing chamber. The most serious problem in solutions disclosed in the cited references is that they admix at least a certain amount of air with liquid. Thus, such solutions are not suitable for use in applications, wherein the air diffused in liquid causes problems in subsequent use of a composition produced in the mixer. One such application is, for example, a mixing process for a coating material used for coating paper or board. A further problem with the solutions set forth in the cited references is the conical shape of mixing chambers used therein, which may induce in the water or the mixture of water and polymer supplied into the chamber, a tendency to strive upwards, thus disturbing the function of the apparatus.

Patent publication WO 01/70382 discloses a system and method for mixing solid matter and liquid. According to the cited publication, the mixing of solid matter and liquid is performed in a mixing vessel by introducing liquid from top of the vessel thereinside for rotatory motion, such that the liquid produces an eddy inside the vessel. The magnitude of an eddy-creating centrifugal force is controlled in such a way that the air core or eddy is not able to reach the liquid outlet. Solid matter to be admixed with the liquid is supplied onto the liquid surface. According to what is described in the cited publication, the depth of an eddy present in the mixing vessel is controlled in such a way that the eddy, and the air confined thereby, cannot reach the mixing vessel outlet, thus inhibiting the escape of mixing-vessel contained air from the mixing vessel through the outlet. As set forth in the cited publication, the mixing-vessel contained air is discharged through a filter bag provided in the top section of the mixing vessel. However, a problem with the system and method disclosed in publication WO 01/70382 is, for example, that the supply of the solid matter to be mixed is effected by means of a screw conveyor, whereby agglomerations possibly present in the solid matter do not effectively disintegrate during the actual passage. Furthermore, since the mixing process, is performed in a so-called gentle manner according to the cited publication, there is a risk that agglomerations present in the solid matter do not break up during the course of mixing, and that the dispersion of solid matter within the liquid shall not be sufficiently thorough.

SUMMARY OF THE INVENTION

It is an object of the method and apparatus of the present invention to eliminate, or at least essentially alleviate problems arising from the foregoing prior art, and to introduce a method and an apparatus for mixing pulverous material with liquid, said apparatus being capable of effectively and reliably mixing particularly one or more pulverous components of a coating material with a liquid component of the coating material.

A further object of the method and apparatus of the present invention is to enable mixing a pulverous material with liquid in such a way that the mixing process does not increase, but instead, at least to some degree, decreases the amount of air and/or air bubbles present in the liquid.

A still further object of the present invention is to provide a method and an apparatus that can be used in conjunction with both batch-type and continuous preparation processes for a coating material.

Yet another object of the present invention is to provide an apparatus, having a construction which is simple, economical and easy to service.

In a typical method according to the invention, liquid is set in rotatory motion within a substantially vertical mixing chamber, the liquid being supplied therein in a substantially tangential manner from a top section of the mixing chamber, such that the liquid is deflected for rotatory motion against a wall of the nixing chamber while advancing, in response to a pressure difference, downwards in the direction of a longitudinal axis of the mixing chamber. At this point in a typical method of the present invention, pulverous material is supplied by means of compressed air into the mixing chamber from the top section of the mixing chamber and into an air core established by the liquid presently in rotatory motion, such that the pulverous material containing little air, and is, by being heavier than the air contained in the pulverous material and/or used for carrying the same, driven in response to a centrifugal force into the liquid presently in rotatory motion, and the air contained in the pulverous material and used for carrying the pulverous material separates towards the eddy center. The liquid containing pulverous material, and the air supplied into the mixing chamber, are discharged through an at least substantially open bottom section of the mixing chamber.

In one preferred method of the present invention, liquid is fed into a supply chamber at a rate which is typically higher than 10 m/s, preferably about 12–18 m/s. If the feed rate of a liquid is too low, for example 4 m/s, there shall not be a sufficiently thorough mixing between powder and liquid. A extremely high feed rate, for example 30–40 m/s, does not substantially improve the mixing between liquid and powder. On the contrary, the use of extremely high feed rates results in a pressure loss, which incurs high operating costs for the apparatus because of high energy demand.

The mixing chamber used in one preferred method of the present invention comprises a cylindrical pipe, having its top section provided with means for introducing liquid and pulverous material into the pipe. The pipe is provided with an open bottom section. The advantage of a mixing chamber in a cylindrical shape, i.e. in the shape of a circular cylinder, preferably a straight circular cylinder, is that the passage of a liquid to be set in downward rotatory motion therein is not disturbed the same way as in steeply conical mixing chambers. Into the mixing chamber, within the zone between the liquid inlet and the mixing chamber bottom section, a tangentially rotating film is developed, into which an air core which also extends all the way to the open bottom section of the mixing chamber, is formed. The open bottom section of the mixing chamber enables the discussed film, i.e. the liquid and the pulverous material dispersed therein, to an unimpeded exit from the mixing chamber without disturbance, in such a way that the liquid and the powder dispersed therein, remain on the chamber wall and the air core extends through the open bottom section beyond the mixing chamber. Thus, the mixing chamber bottom section cannot develop any adverse eddy that would result in mixing air with liquid.

In a highly preferred method of the present invention, the liquid, containing pulverous material, is fed from a mixing chamber to a mixing tank. Thus, the mixing time for powder can be increased, if necessary. Moreover, since the liquid and the pulverous material dispersed therein, as well as the air supplied into the mixing chamber, are discharged from the mixing chamber bottom section into a mixing tank, the mixing chamber need not be provided with separate elements, such as bag filters, for expelling air from the mixing chamber top section. In a highly preferred case, the injection of a pulverous-material containing liquid is directed to a mixer present in the mixing tank, the dispersion of powder being enhanced as the pulverous-material containing liquid hits the spot in the mixing tank, at which the mixer-inflicted agitation is at its most powerful.

In one preferred method of the present invention, the liquid supplied into a mixing chamber comprises a coating material used for coating paper or other such web material, or pigment slurry used for making a coating material. In this context, the pigment slurry refers to a liquid, having a dry content which is typically higher than 40%, most often even higher than 65%. In addition, it is typical for pigment slurry of the presently discussed type that its density is typically about 1300–1800 kg/m$^3$ and that its viscosity is typically about 100–2000 mPas.

In a preferred method of the present invention, the pulverous material supplied into a mixing chamber comprises a powdered or granulated component of a coating material used for coating paper or the like web material according to the inventive method, or a mixture thereof.

A typical apparatus according to the present invention comprises a substantially vertical mixing chamber, having its top section tangentially provided with a first inlet, whereby a liquid is arranged to be supplied into the mixing chamber, such that the liquid is deflected for rotatory motion against a wall of the mixing chamber, while progressing, in response to a pressure difference, downwards in the direction of a longitudinal axis of the mixing chamber, and having its top section provided with a second inlet, which is fitted with elements for feeding in a pulverous material with compressed air and whereby the pulverous material is adapted to be supplied into the mixing chamber and into an air core established by the liquid presently in rotatory motion, such that the pulverous material which contains little air, and by being heavier than the air contained in the pulverous material and/or used for carrying the same, is delivered in response to a centrifugal force into the liquid presently in rotatory motion and the pulverous material, which contains an abundant amount of air, separates toward the eddy center, and said mixing chamber having its bottom section provided with an outlet for expelling from the mixing chamber the pulverous-material containing liquid and the air supplied earlier into the mixing chamber.

In one preferred apparatus according to the present invention, a supply pipe is fitted in connection with the second inlet, which pipe extends within the mixing chamber into the center of an eddy established in its middle section by a liquid, whereby the pulverous material is arranged to be fed into the mixing chamber. By means of the supply pipe, the pulverous material can be delivered to the very spot in the mixing chamber and to the center of an eddy developing in it, from which the pulverous material is best absorbed into the liquid spiralling within the chamber.

In a preferred apparatus according to the present invention, the outlet is arranged in the mixing chamber in such a way that the mixing chamber is arranged to be at least substantially open in its bottom section, whereby the liquid and the powder dispersed therein, as well as the air supplied within the mixing chamber, are essentially free to escape from the mixing chamber.

In a preferred apparatus according to the present invention, in connection with the first inlet, a spiral deflector is arranged in the mixing chamber for enhancing the rotatory motion of liquid downward in the direction of a longitudinal axis of the mixing chamber. With respect to the function of an apparatus of the invention, the spiral deflector is not indispensable, since the pressure difference alone diverts the liquid and the pulverous material presently dispersing therein to travel downward in the direction of a longitudinal axis of the mixing chamber.

In a particularly preferred exemplary embodiment of the present invention, the inventive apparatus is set in communication with a mixing tank. In this case, it is further preferred that, if necessary, the injection of a pulverous-material containing liquid be guided to a mixer present in the mixing tank, for example by means of a separate deflector. By means of the above arrangement, the mixing time of a powder within the liquid can be increased, if necessary. Guiding the liquid injection to the mixer enhances the dispersion of a powder as the pulverous-material containing liquid hits the spot in the mixing tank, at which the mixer-inflicted agitation is at its most powerful.

The most important advantage of the method and apparatus according to the invention is that the method itself, as well as the apparatus, are very simple and reliable in operation. Hence, they can be used even in the case that pulverous material is mixed with a liquid other than water. The apparatus requires very little maintenance, which is why the apparatus essentially incurs investment costs only, and hardly any operating expenses. Even said investment costs are low, by virtue of a simple design of the apparatus.

Another important advantage of the method and apparatus according to the invention is that the mixing process involves no air mixing with liquid, but, instead, the amount of air in the liquid actually decreases.

A further advantage of the pneumatic feed of pulverous material used in a method and apparatus according to the present invention is that the particles of a pulverous material can be separated from each other, whereby the pulverous material released into the air core does not contain lumps of particles, the dispersion of which within the liquid would be particularly difficult.

In addition, the application of a method and apparatus according to the invention to various processes, especially to preparation processes for coating materials used in the coating of paper or other such material, is easy and simple, since the method and apparatus are highly applicable in conjunction with both batch-type and continuous preparation processes. Another reason why the application to various processes is easy is that a method and apparatus according to the invention are also applicable for use, for example, in mixing processes for mixing pulverous material with pigment slurry.

Furthermore, by means of the method and apparatus according to the invention, mixing times of pulverous materials are substantially reduced, as compared to conventional mixing which is performed without a premixing process according to the present invention.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
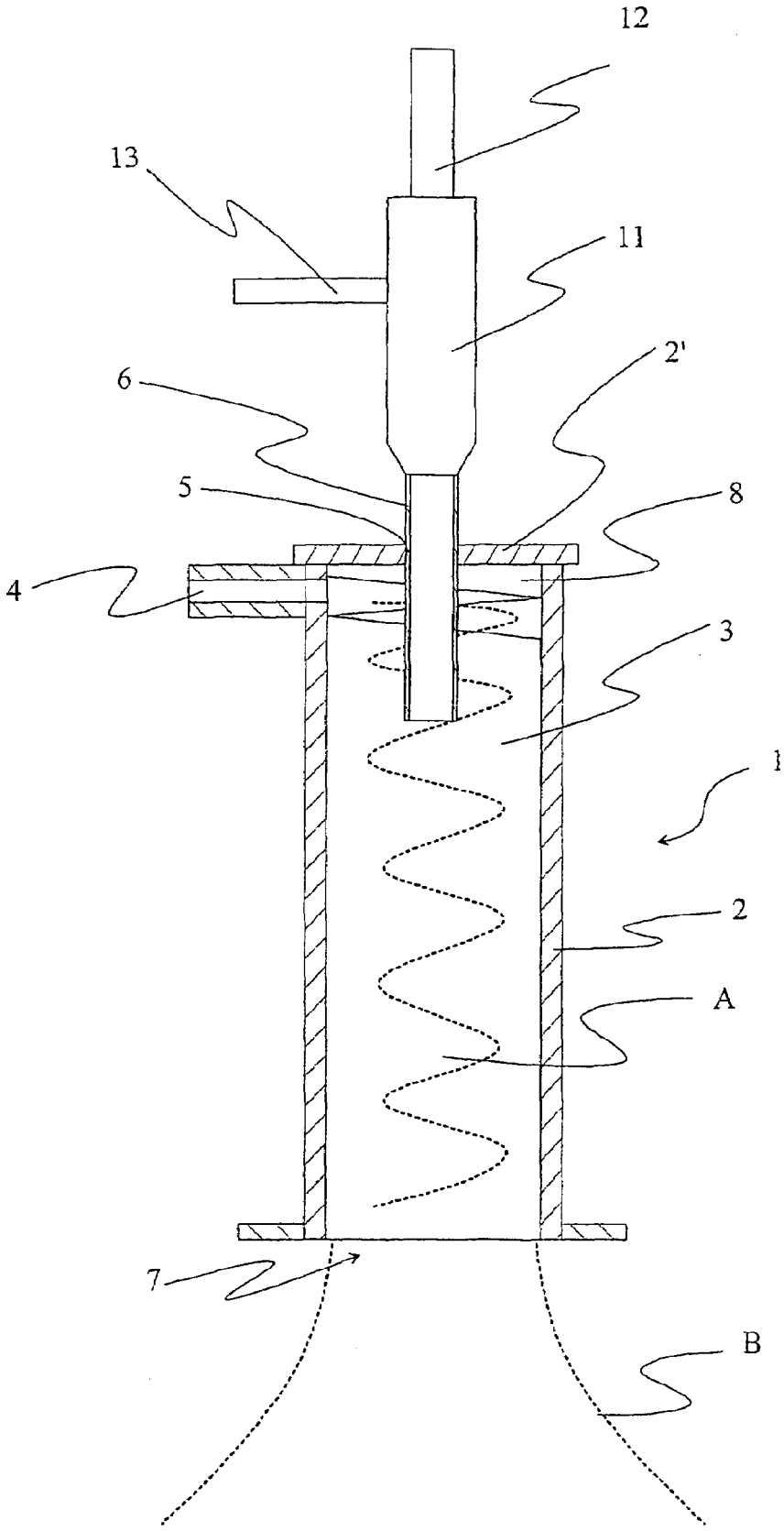
FIG. 1 shows schematically an apparatus according to the invention in a sectional view.

FIG. 1 shows schematically and by way of example a sectional view of an apparatus according to the present invention. The apparatus is generally designated with reference numeral 1. The apparatus 1 is in functional sense based on the use of a centrifugal force in a process of mixing a pulverous material with a liquid, particularly with a coating material used for coating paper or other such web-like material, or with a liquid component of a coating material, such as, for example, pigment slurry. The pulverous material may comprise for example CMC, cold-soluble starch, or soybean protein. The apparatus 1 comprises an upright, stationary cylinder pipe 2 which, together with a top cover 2' attached thereto with appropriate fasteners, defines a mixing chamber 3.

Liquid material, which is referred to as liquid in the specification, is fed into the cylinder pipe 2 through the first inlet 4 at the top end of the cylinder pipe 2. The top cover 2' is fitted with a supply pipe 6, mounted in conjunction with a second inlet 5, for feeding a pulverous material, which is referred to as powder in the subsequent specification, into the cylinder pipe 2. As shown in the figure, the supply pipe 6 extends into the interior of the cylinder pipe 2, into the center of an eddy established by the liquid. The supply pipe 6 may have its length adjusted, for example to comply with the properties of a powder to be supplied in view of providing as effective mixing of powder with liquid as possible. The eddy created by the liquid aspirates the powder delivered by the supply pipe to thus begin the mixing of powder with liquid.

The liquid, and the powder dispersed therein, are conducted out of the interior of the cylinder pipe 2 by way of an outlet 7 arranged in the bottom end of the cylinder pipe 2. The first inlet is arranged tangentially with respect to the cylinder pipe 2 of the apparatus 1, such that the liquid is set in rotatory motion within the cylinder pipe 2 and deflected against a wall of the cylinder pipe 2. The outlet 7 is designed in such a way that the bottom end of the cylinder pipe 2 is left open.

FIG. 1 depicts further that the apparatus 1 has its supply end, in connection with the first inlet 4, provided with a spiral deflector 8 for guiding the liquid downward in the direction of a longitudinal axis of the cylinder pipe 2. The spiral deflector 8 can be an integral part of the top cover 2', or it can be attached to the top cover 2' or to the walls of the cylinder pipe 2 by means of fasteners suitable for the attachment of a deflector. As already pointed out, the spiral deflector 8 is not necessary from the functional aspect of the apparatus, since the pressure difference alone is enough to urge the liquid to travel downward in the direction of a longitudinal axis of the cylinder pipe 2.

The rotatory motion established for liquid within the cylinder pipe 2 creates in a coating material, and in a powder mixing therewith, a pressure gradient, the result of which is that air, being lighter than the liquid and the powder, separates towards the eddy center. Thus, an air core is developed in the middle section of the cylinder pipe, as indicated with reference symbol A in the figure. Reference symbol B represents a mixture of the liquid and the powder dispersed therein.

The air, separated from the liquid and the powder dispersed therein, escapes in the apparatus illustrated in the figure through the open bottom end of the cylinder pipe 2. The air could be expelled from the apparatus also by providing the top end 2' of the apparatus with a vent pipe, which would appropriately extend into the interior of the air core A. The vent pipe could be introduced for example centrally within the supply pipe 6. The vent pipe length could be adjusted, for example, to comply with the properties of a liquid for providing an air discharge as effective as possible.

It is quite obvious that the first inlet 4 and the second inlet 5 may vary in terms of size and orifice dimensions, and the same applies to the supply pipe 6 regarding its length and orifice size. The orifice dimensions and the pipe length are selected in view of complying with applied inlet pressures, inlet capacities, viscosity of the liquid, diameter of the cylinder pipe 2, etc. The figure indicates that the pipe, constituting the first inlet 4, extends in a direction perpendicular to the longitudinal axis of the cylinder pipe 2 in the apparatus 1. The first inlet 4 can also be arranged in an appropriately inclined orientation for enhanced control over the liquid flow within the apparatus 1. In the FIG. 1, the second inlet 5 is shown with and parallel to the longitudinal axis of the cylinder pipe 2. The second inlet can also be appropriately arranged in an inclined and/or eccentric position for enhancing the aspiration of powder to liquid.

FIG. 1 indicates that the cylinder pipe 2 is in the shape of a round circular cylinder. Hence, the cylinder pipe is straight-walled, i.e. its diameter is substantially equal over the entire lengthwise axis of the cylinder pipe 2. As a rule, a straight cylinder pipe is preferred to a tapered pipe, since, especially at high liquid supply rates, a conical surface may exhibit the effect that the liquid in fact endeavors to rise up towards a larger diameter, whereby the apparatus does not function as desired.

FIG. 1 indicates further that the supply pipe 6 is provided with a per se known ejector 11, the structure of which is not illustrated more precisely in the figure. Making use of compressed air delivered to the ejector by way of a pneumatic line 13, the ejector 11 enables drawing in pulverous material along a powder line 12 to the ejector 11 for feeding it therefrom into the apparatus 1. Possible particle agglomerations present in the pulverous material break up in response to an air drag applied to powder particles in the ejector, as a result of which the pulverous material fed into the apparatus 1 has its powder particles disengaged from each other. A pulverous material supply arrangement, which feeds air into the apparatus 1, does not cause problems in the operation of an apparatus according to the invention, since the air delivered into the apparatus is not mixed with liquid. The ejector 11 need not be in connection with the apparatus 1, as it can also be located somewhere else along the powder line 12. The pulverous material could be supplied into the apparatus 1 also by the application of some other feeding method capable of separating powder particles from each other.

Figure 2:
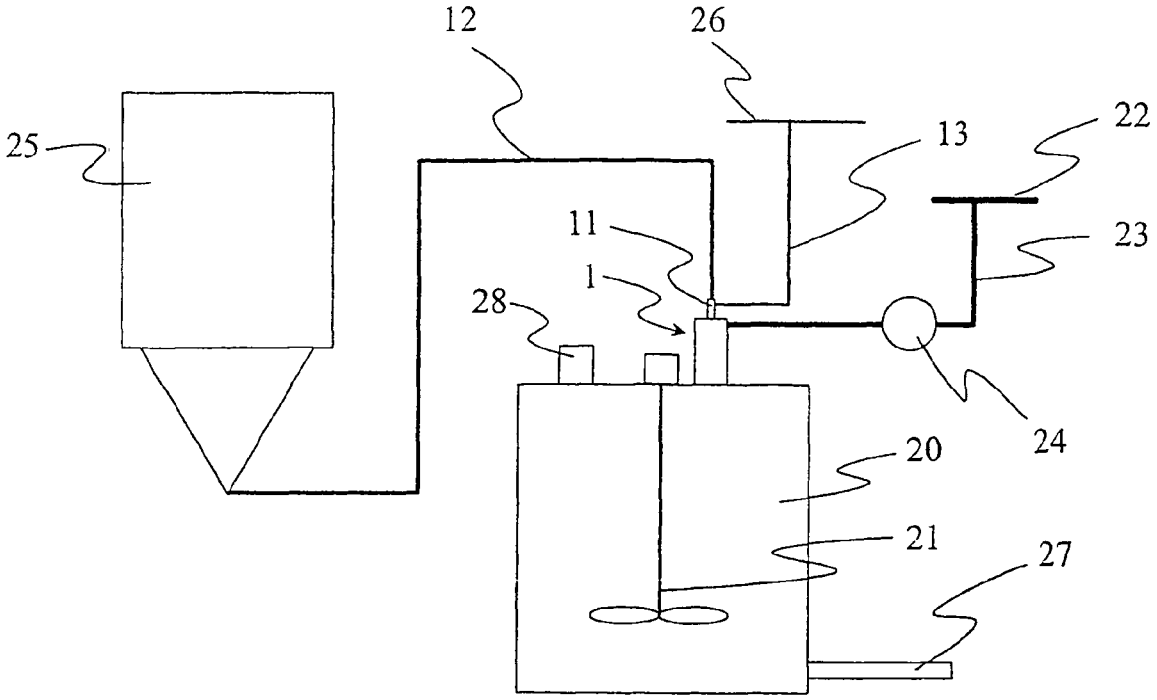
FIG. 2 shows schematically an apparatus according to the invention, installed as part of a batch-type mixing process for a coating material.

FIG. 2 depicts schematically and by way of example one solution for using the apparatus of FIG. 1 in connection with a batch-type powder-liquid mixing process, especially in connection with a mixing process for a coating material or its components. The apparatus 1 is arranged in connection with a mixing tank 20, such that an injection of liquid and powder dispersed therein is deflected from the apparatus 1 into the mixing tank 20, and there into the most powerful mixing zone of a rotor mixer 21. The air, separated from the liquid and the powder dispersed therein, discharges into and out of the mixing tank 20 by way of a filter 28 arranged in the mixing tank 20.

As indicated in FIG. 2, the liquid, such as pigment slurry, to be introduced into the apparatus 1 is supplied to the apparatus from a pigment slurry circulation line 22 along a supply line 23. The supply line is provided with a pump 24 for controlling the feed rate of a liquid to be supplied to the apparatus 1. The applied feed rate is selected, among other things, on the basis of the properties of a liquid to be supplied and a powder to be mixed therewith. Typically, the liquid is subjected to feed rates in the order of about 12–18 m/s. The feed rate must be sufficiently high, such that the presently developing liquid eddy is capable of effectively aspirating the powder, which is to be mixed with the liquid, into the liquid, instead of allowing the powder to adhere to the walls of the mixing chamber. The powder, which is to be mixed with the liquid, is aspirated by means of the ejector 11 along the powder line 12 from a silo 25 of pulverous material. The compressed air driven by the ejector 11 is supplied to the ejector 11 along the pneumatic line 13 from a pneumatic mains 26. The feed rate of powder in the powder line is typically about 20–30 m/s. As pointed out above, the supply of powder into the apparatus could also be implemented by some other means instead of using an ejector.

When, in a batch-type mixing process as depicted in FIG. 2, the mixing tank, having a volume which is typically about 5–15 $m^3$, is filled to a desired volume, the mixing of powder with liquid can be continued, after the premixing carried out in the apparatus 1, by agitating the liquid with the rotor mixer 21. The mixing tank 20 can be also used for agitating a mixture of more than one liquid and powder at the same time. In this case, all of the components to be mixed in the mixing tank can be supplied by way of the apparatus 1, or the mixing tank could have been provided with more than one piece of equipment according to the invention. In addition, the mixing tank can be supplied with components, for example, directly from circulation lines, for example from circulation lines for pigment slurries or from powder silos. The batch mixed in the mixing tank can be pumped from the tank along a discharge line 27, for example to a paper coating machine.

Figure 3:
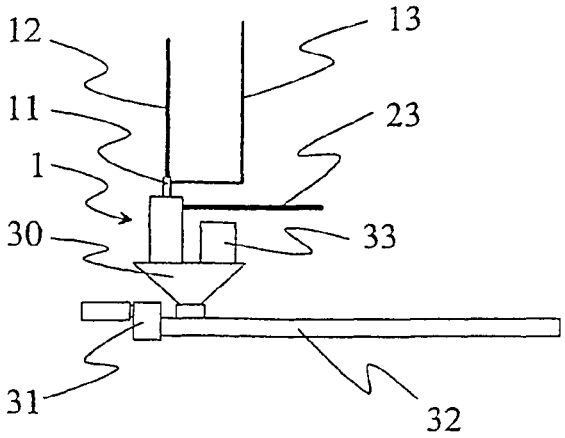
FIG. 3 shows schematically an apparatus according to the invention, installed as part of a continuous mixing process for a coating material.

FIG. 3 depicts schematically and by way of example one solution for using the apparatus of FIG. 1 in connection with a continuous powder-liquid mixing process, especially in connection with a mixing process for a coating material or its components. The apparatus 1 according to the invention is fitted in connection with an air separation cyclone 30, which is in connection with a transfer line 32 provided with a pump 31, for example a screw pump, and which could be fitted with a static mixer for an intensified mixing process. The practical function of the cyclone 30 is to operate primarily as an intermediate storage for maintaining the liquid level essentially constant to prevent the pump 31 from pumping air alone. The liquid, and the powder to be mixed therewith, can be supplied to the apparatus 1 according to the invention as depicted in reference to FIG. 2, for example. FIG. 3 illustrates additionally a filter 13, whereby the air, discharged into the cyclone 30 from the apparatus 1, exits into a process space.

There is no intention to limit the invention merely to the embodiments described in the foregoing specification, but it can be varied within the scope of the inventive concept defined in the appended claims.

The invention claimed is:

1. A method for mixing pulverous material with liquid in a substantially vertical mixing chamber comprising the steps of:

setting a liquid in rotatory motion within the substantially vertical mixing chamber, by supplying the liquid in a substantially tangential manner from a top section of the mixing chamber, such that the liquid is deflected into rotatory motion against a wall of the mixing chamber;

advancing the liquid downwards in a downward longitudinal direction along a longitudinal axis of the mixing chamber, in response to a pressure difference in the downward longitudinal direction; and supplying the pulverous material and air contained in the pulverous material by use of compressed air into the mixing chamber from the top section of the mixing chamber into an air core established by the liquid in rotatory motion within the mixing chamber, wherein the pulverous material is driven in response to a centrifugal force into the liquid in rotatory motion within the mixing chamber forming a liquid containing pulverous material, and the air contained in the pulverous material and the air used for carrying the pulverous material is separated towards an eddy center defined by the air core, and wherein the liquid containing pulverous material, and the air contained in the pulverous material and the air used for carrying the pulverous material, are discharged through an at least mainly open bottom section of the mixing chamber.

2. The method of claim 1 wherein the liquid is fed into the supply chamber at a rate which is higher than 10 m/s.

3. The method of claim 2, wherein the liquid containing pulverous material is fed from the mixing chamber to a mixing tank.

4. The method of claim 3, wherein the liquid containing pulverous material is injected directly to a mixer present in the mixing tank.

5. The method of claim 1 wherein the liquid is fed into the supply chamber at a rate which is between about 12 and about 18 m/s.

6. The method of claim 1 wherein the substantially vertical mixing chamber is a cylindrical pipe having a top, the top having a means for introducing liquid and pulverous material into the cylindrical pipe, the cylindrical pipe having a bottom section which is open, the open bottom section dispersing the liquid containing pulverous material forming a film, which exits unimpeded from the mixing chamber without disturbance, in such a way that the liquid containing pulverous material travels along the chamber wall and the air core extends through the open bottom section.

7. The method of claim 1, wherein the liquid supplied into the mixing chamber is coating material used for coating paper or other web material, or pigment slurry used for making coating material.

8. The method of claim 1 wherein the liquid supplied into the mixing chamber is a component for a coating material used for coating paper or other such web material or of a mixture thereof.

9. A method for mixing pulverous material with liquid comprising the steps of:

supplying the liquid in a substantially tangential manner to atop section of a mixing chamber having a substantially cylindrical wall, to cause the liquid to rotate against the substantially cylindrical wall of the mixing chamber;

advancing the liquid downwards in a downward longitudinal direction along a longitudinal axis defined by the cylindrical wall of the mixing chamber, in response to a pressure difference in the downward longitudinal direction; and supplying pulverous material carried by air into the mixing chamber from the top section of the mixing chamber into an air core established by the liquid in rotatory motion within the mixing chamber, wherein the pulverous material is driven in response to a centrifugal force into the liquid in rotatory motion within the mixing chamber, and wherein the liquid now containing the pulverous material, and the air supplied into the mixing chamber, are discharged through an at least mainly open bottom section of the mixing chamber.

10. The method of claim 9 wherein the liquid is fed into the supply chamber at a rate which is higher than 10 m/s.

11. The method of claim 9 wherein the mixing chamber is a cylindrical pipe having a top, forming the top section, the cylindrical pipe having a bottom section which is open, the open bottom section dispersing the liquid containing the pulverous material as a film, which exits unimpeded from the mixing chamber without disturbance, in such a way that the liquid containing the pulverous material travels along the chamber wall and the air core extends through the open bottom section.

* * * * *